US006513573B1

(12) United States Patent
Guasto et al.

(10) Patent No.: US 6,513,573 B1
(45) Date of Patent: Feb. 4, 2003

(54) REFRACTORY PLATES FOR CONTINUOUS CASTING MACHINES OF THIN FLAT PRODUCTS

(75) Inventors: Giuseppe Guasto, Rome (IT); Riccardo Tonelli, Rome (IT)

(73) Assignees: Acciai Speciali Terni S.p.A. (IT); Voest-Alpine Industrieanlagenbau GmbH (AT)

( * ) Notice: Subject to any disclaimer, the term of this patent is extended or adjusted under 35 U.S.C. 154(b) by 0 days.

(21) Appl. No.: 09/869,552

(22) PCT Filed: Dec. 30, 1999

(86) PCT No.: PCT/IT99/00430

§ 371 (c)(1),
(2), (4) Date: Sep. 27, 2001

(87) PCT Pub. No.: WO00/40355

PCT Pub. Date: Jul. 13, 2000

(30) Foreign Application Priority Data

Dec. 31, 1998 (IT) ..... RM98A0820

(51) Int. Cl.[7] ..... B22D 11/06
(52) U.S. Cl. ..... 164/428; 164/480
(58) Field of Search ..... 164/428, 480

(56) References Cited

U.S. PATENT DOCUMENTS 5,247,987 A * 9/1993 Tavernier et al. ..... 164/428
5,924,476 A * 7/1999 Spink ..... 164/480
6,145,581 A * 11/2000 Takeuchi et al. ..... 164/472
6,378,598 B1 * 4/2002 Tonelli et al. ..... 164/428

FOREIGN PATENT DOCUMENTS

JP 60162557 8/1985
JP 02075450 3/1990
JP 3-207554 * 9/1991 ..... B22D/11/06
JP 9-155509 * 6/1997 ..... B22D/11/06

* cited by examiner

*Primary Examiner*—M. Alexandra Elve
*Assistant Examiner*—Kevin P. Kerns
(74) *Attorney, Agent, or Firm*—Michael Best & Friedrich, LLP

(57) ABSTRACT

A refractory plate member (8) for the side containment in continuous casting machines of the type with two counter-rotating rollers (1, 2), including two or more overlapped ceramic and/or refractory layers is provided, the plate member (8) is characterized in that the first layer (9, 91) of said plate member (8) is made of a material that is easily wearable under the action of said rolls (1, 2) during the starting step, and in that the second layer (10, 101) underlying the first layer is made of a ceramic and/or refractory and/or carbon material having a very high wear and thermal shock resistance and self-lubricating properties.

14 Claims, 3 Drawing Sheets

REFRACTORY PLATES FOR CONTINUOUS CASTING MACHINES OF THIN FLAT PRODUCTS

TECHNICAL FIELD

The present invention relates to an improvement for refractory plates for the side containment in continuous casting machines of thin flat products such as a strip, and to a process for the manufacture thereof.

BACKGROUND AND SUMMARY OF THE INVENTION

Usually, continuous casting machines of thin flat bodies have a pair of parallel counterrotating rolls which internally are cooled with water. At each side thereof face two flat walls, each of them having a refractory plate, thus constituting the mould. During casting, the plates are kept abutting onto each side of the rolls, thus enabling the side containment of the molten metal. The molten product cast between said rolls forms a thin flat product.

Various problems exist, due to the high temperatures reached at the starting and in the operation for these types of apparatuses. In fact, reaching high temperatures entails remarkable strains to the refractory plates and the casting rolls. Plate strains are already apparent at the preheating stage, whereas the roll strains derive from the contact of the same with the molten metal during the casting for thin strip formation. These strains, mainly taking place at the initial stages of casting, make it difficult to realize a correct coupling of the refractory plates onto the arc of contact with the casting rolls. This can promote molten metal penetrations, actually hindering the effective containment of the molten metal inside the mould.

Therefore, in order to overcome this problem, the plate material should be relatively soft, thus enabling the rotating rolls to swiftly abrade the plate material at the start of the process to obtain a satisfactory surface coupling, thus providing a seal against molten metal penetrations.

On the other hand, in order to ensure long enough casting times, the plate is required not to wear out too rapidly during the steady state.

Moreover, the adopted material must possess non-wettability and chemical inertia characteristics towards the molten metal, as well as be resistant to the thermal shock caused by the contact with the molten metal at the start of casting. The materials most widely used in the state of the art in forming the portion of the plate contacting the rolls and the molten metal are products made of BN, SiON and/or compounds thereof, as a monolithe or as inserts.

Such types of materials possess the aforedescribed chemical and physical characteristics. Being relatively soft products, these materials have a low abrasion wear and thermal resistance.

The refractory plates for the side containment thus formed are subject to rapid wear, unavoidably leading to rapid consumption of the aforesaid plates, resulting in premature shutdown of the casting process. This problem raises great difficulties in the industrial manufacture of big volumes of thin flat products such as strips or the like.

Over the years, various technical solutions for lubrication of the area of contact between the refractory plates and the rolls have been proposed, aimed at reduction of friction, and therefore the wear of the plate materials. One of these solutions lies in the use of liquid lubricants, e.g. various greases and oils, or solid lubricants, such as graphite and boron nitride that are fed at the entrance of the contacting area between the refractory plates and the edges of the rolls. In the operative thermal conditions, the solvent-carried lubricants exhibit low effectiveness, as in practice they are quickly degraded and volatilized, whereas the solid lubricants can penetrate only a small fraction of the contacting area between the roll and the refractory plate. Moreover, in both instances steel bath pollution problems might arise.

Another technical solution is disclosed in EP 0588743 B1, providing thin film coatings onto the aforesaid plates, made with self-lubricating polymers and having thicknesses of between 0.01÷0.1 mm, added to the refractory materials at the contact area with the rolls.

Such coatings, although charged with glass and/or metallic fibers, are unavoidably destined to rapid wearing due to the scantily added thickness thereof and the thermal conditions of the process, both for the abrasive action exerted by the compression of the rotating rolls and for the operative temperatures of the system. All this makes the use of self-lubricating polymeric structures, even special ones such as TEFLON or PFE, non suitable to overcome the problems of the wear of the refractory plate at the area contacting the rolls, and the correct coupling thereof.

However, self-lubricating films of reduced thickness do not promote a reduction in the wear of the refractory material at the start of the casting process. As would instead be desirable from the start of the process, a correct coupling between plates and rolls would thus prevent a possible penetration of the molten metal between the two contacting walls. Moreover, if such thin coatings that operate under such prohibitive thermomechanical conditions are worn or removed, for instance by molten metal penetration, the problem of the wear of the underlying refractory material crops up anew. An alternative technology is disclosed in JP03207554A and U.S. Pat. No. 5,247,987, wherein side dams are provided with a multi-layer structure in order to promote an initial wearing of the same from the very start of the casting process.

BRIEF SUMMARY OF THE INVENTION

Therefore, it is an object of the present invention to overcome the abovementioned drawbacks by providing plates for side containment in continuous casting machines which are suitable for rapidly adapting to the pattern of the roll edge, thus avoiding cracks along the contact area between the plate and the roll—cracks that can easily lead to molten metal penetrations.

Another object of the present invention is to provide plates for side containment of continuous casting machines which are suitable to overcome the problem of premature abrasion of the same, thereby increasing the duration of the entire casting process and therefore the volume for each individual casting operation.

Therefore, according to the present invention, a refractory plate member is provided for side containment in continuous casting machines of the type including two counterrotating rolls, said plate member including two or more overlapped ceramic and/or refractory layers, wherein the first layer of said plate member is suitable for contacting the rolls and is made of a material that is easily wearable under the action of said rolls during the starting step, and the second layer underlying said first layer made of a material having a very high wear and thermal shock resistance, the plate member being characterized in that said first layer is made of a material including 20 to 30% BN by weight with respect to the total weight; the remaining weight being made of one of more of $Al_2O_3$, $SiO_2$, SiC, $ZrO_2$, and/or SiAlON, and by a refractory fibrous casting having an aluminum and/or silicon/aluminum and/or zirconium-based matrix, said casting being realized with $Al_2O_3$ and/or $SiO_2$ and/or $ZrO_2$ powders having a size grain of over 60 $\mu$m; and said second layer comprises a graphitic carbon material obtained through a hot pressing process starting from a carbon matrix, with a grain size comprised from 30 to 250 $\mu$m wherein graphite flakes having a size comprised from 50 to 125 $\mu$m and a final porosity from 6 to 15% are incorporated, Advantageously, according to the present invention, the refractory plate for side containment of molten metal in a mould is made of at least one member made of two or more overlapped layers of refractory and/or ceramic material having different abrasion wear resistance characteristics. In fact, the plate member consists of an outer layer made of a material that is quickly wearable by the sliding action of the rolls during the starting of the casting process. Thus, during the starting phase when the plates are pressed against the rolls sides and prior to the pouring of the molten metal, the refractory material is rapidly wearable at the contacting area by the edges of the rolls that indent the plates for a thickness sufficient to ensure optimum containment of the molten metal to be subsequently cast between the rolls.

Advantageously, the coupling obtained with the described step enables avoidance of the formation of cracks in the contact area between the rolls and the side containment plates, and therefore possible molten metal penetrations.

Moreover, according to the present invention, the material forming said outer layer has non-wettability, chemical inertia to the molten metal, and thermal shock resistance, as required by the casting process.

Further, the innermost layer of the plate member, i.e. the layer not directly contacting the molten bath, is advantageously realized in a refractory and/or ceramic material characterized by high hardness, high mechanical high temperature wear, and self-lubricating features.

According to the embodiment of the invention, this allows an optimal side containment of the molten bath, because after the outermost layer is worn, the rolls sides rapidly contact the underlying layer, which is characterized by a very high wear resistance, very small friction coefficient, allowing therefor very limited consumption, and thus enabling the implementation of prolonged castings of thin flat products.

A further advantage provided by the invention is that of maintaining in the central zone of the plate contacting the molten metal, a layer of material having suitable chemical and physical characteristics suitable for resisting molten metal attack, enabling to the underlying layer the sole function of resisting hot wear caused by the casting rolls. In fact, the outer layer is solely removed along the sliding arc of contact area of the rolls.

BRIEF DESCRIPTION OF THE DRAWINGS

A detailed description of preferred embodiments of the present invention will be disclosed hereinafter, given by way of example and not for limitative purposes, making reference to the annexed drawings, wherein.

DETAILED DESCRIPTION OF THE INVENTION

Figure 1:
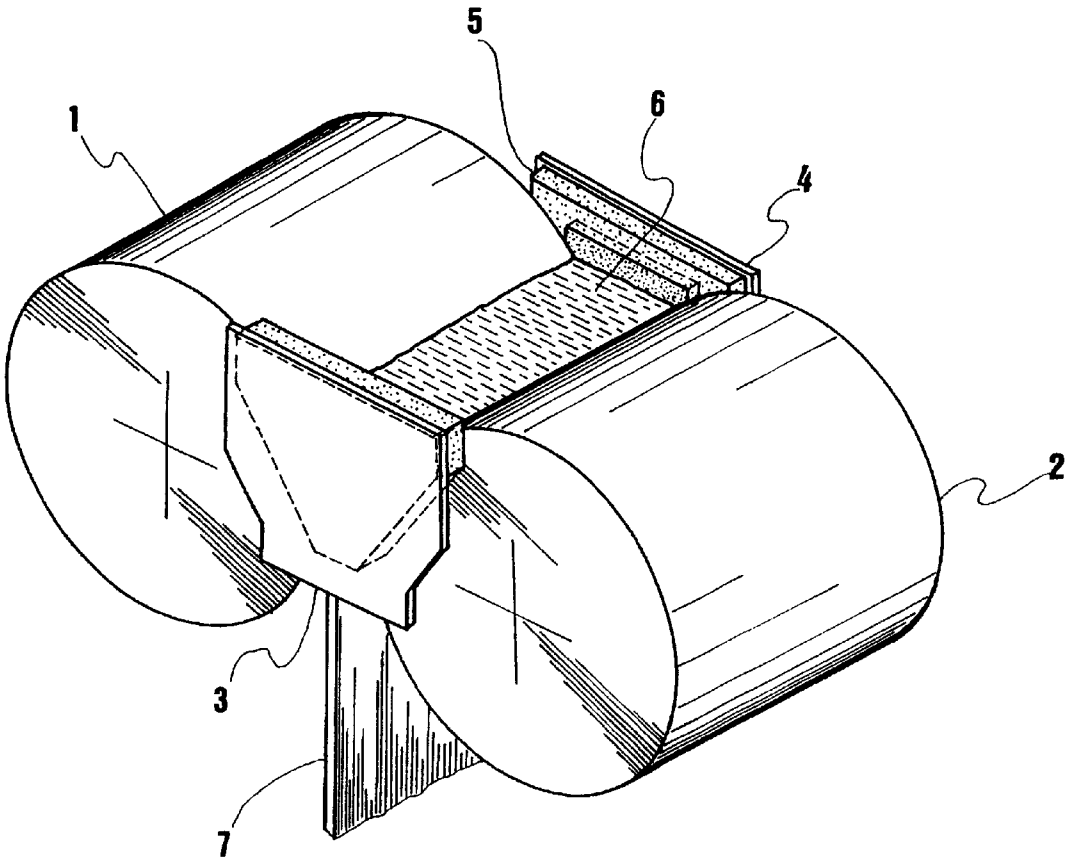
FIG. 1 is a perspective schematic view of an apparatus for the continuous casting of flat products.

Making reference to FIG. 1, a machine for the continuous casting of thin flat products is schematically shown, the machine having a pair of counterrotating rollers 1 and 2, internally cooled with water and parallel axes of rotation thereof. At the side faces of said rolls 1, 2, two side walls 3 and 4 are positioned, having respective refractory plates 5, the latter when kept compressed against the casting rolls enable the side containment of molten metal 6 cast between the rolls 1, 2 and said walls 3, 4. The rotation of said rolls 1 and 2 with the molten metal cast therebetween, forms a thin flat product 7.

Figure 2:
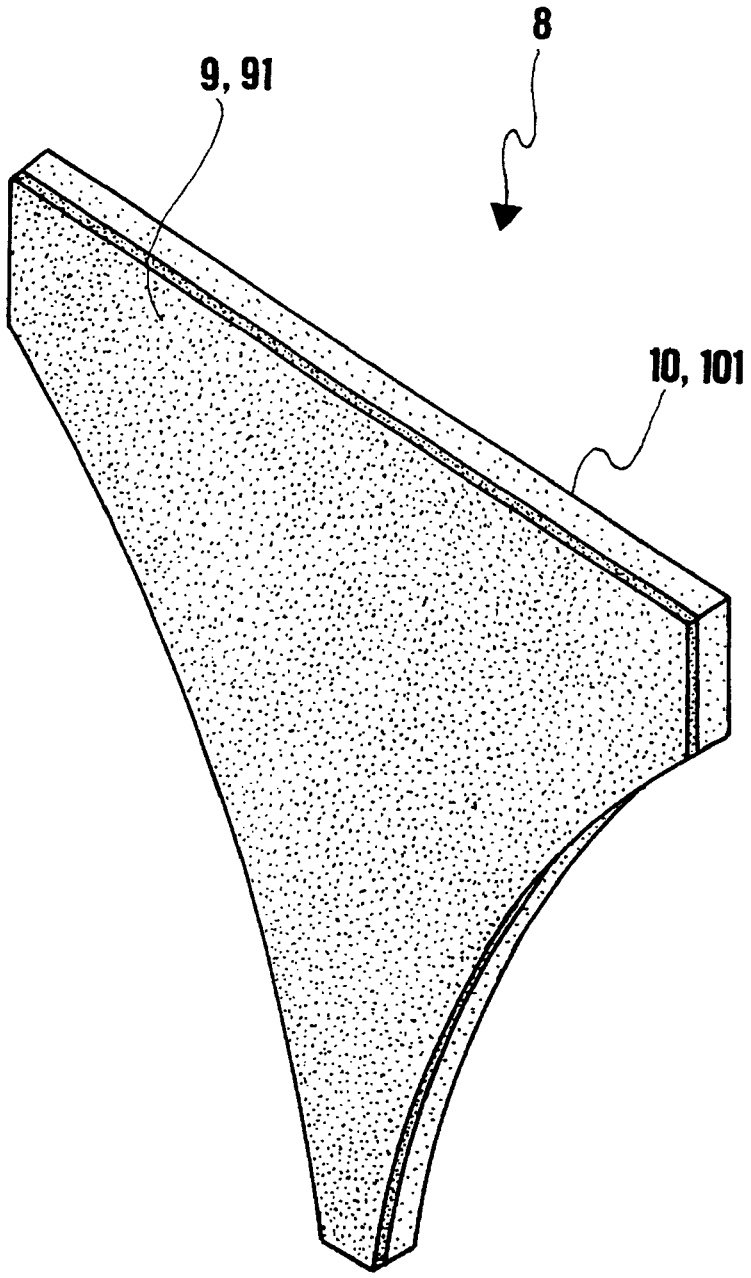
FIG. 2 is a schematic view of a plate member according to the present invention.

Referring now to FIG. 2, a plate member according to the present invention is schematically shown.

According to a first embodiment of the present invention, the plate member 8 is implemented with two or more layers, a first outermost layer 9 thereof being destined to contact the rolls 1, 2 and the molten bath 6. Said first layer 9 is comprises of a ceramic product made of boron nitride or compounds thereof, characterized by low hardness, chemical inertia, and low wettability with respect to molten metal. Preferably, such an outer layer 9 has a thickness ranging between 0.2 and 5 mm and is located over an innermost layer 10 comprised of a material characterized by high resistance to mechanical high temperature wear and intrinsic self-lubricating properties, thereby minimizing the friction coefficient between the edges of the rolls 1, 2 and the material itself.

A graphitic carbon material of a $\geqq$50 Shore hardness and a 5–20 mm thickness can be used for this innermost layer 10.

According to this embodiment, the outer layer 9 is made of a material including a mixture of 20 to 30% BN by weight with respect to the total weight, the remaining being made of one or more of $Al_2O_3$, $SiO_2$, SiC, $ZrO_2$, and/or SiAlON. The material thus realized has an apparent porosity lower than 4%.

Furthermore, according to the embodiment, the inner layer 10 is made of a graphitic carbon material obtained through a hot pressing process starting from a carbon matrix with a grain size ranging from 30 to 250 $\mu$m wherein graphite flakes with a size ranging from 50 to 125 $\mu$m are incorporated. Thus, a material having a porosity from 6 to 15% is obtained.

It has to be pointed out that the plate member thus formed can be obtained with an isostatic hot pressing as well as with a simultaneous sintering of these two layers.

According to a second embodiment of the plate member of the present invention, the plate member has a first outer layer 91 made of a refractory fibrous casting of a aluminum and/or silicon-aluminum and/or zirconium oxide-based matrix, thus having low hardness and being easily wearable by the rotating action of the rolls during the casting process. Said refractory fibrous casting materials include $Al_2O_3$ and/or $SiO_2$ and/or $ZrO_2$ powders and fibers having sizes lower than 60 $\mu$m, showing the required resistance to chemical attacks and a low wettability with respect to the molten metal.

The material thus formed has a grain size from 10 to 60 $\mu$m and a porosity ranging from 10 to 15%. The thickness of such an outer layer is preferably from 1 to 5 mm.

On the other hand, the material underlying the first layer 91, is the layer 101 which can be made of a graphitic carbon material as the one hereto described in the first embodiment.

Figure 3:
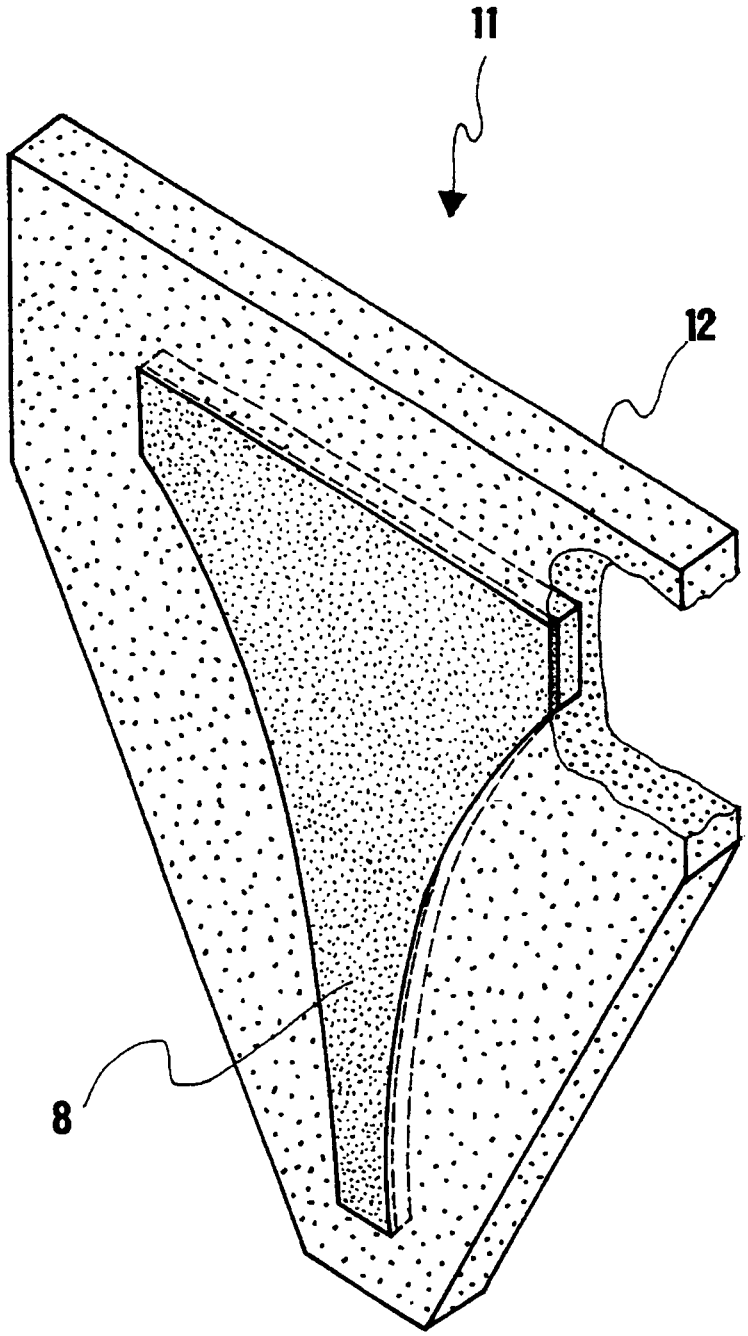
FIG. 3 is a schematic view of a plate incorporating a plate member according to the present invention.

Referring now to FIG. 3, a plate 11 for the side containment in continuous casting machines is constituted according to the present invention. According to the invention, the plate 11 includes a matrix material 12 that, preferably, can be obtained by means of casting of a SiC-based thixotropic material made of a mixture of the following compounds, expressed as percentage by weight with respect to the total weight: $Al_2O_3$ from 5% to 15%; $SiO_2$ from 2% to 4.5%; SiC from 80% to 95%; the remaining substantially being impurities.

Inside said matrix 12 and at the contacting area of the edges of the rolls 1 and 2, a plate member 8 like the one hereto extensively described, is positioned. The positioning of the member 8 onto the matrix can be monolithic or with more inserts obtained through simultaneous hot pressing or sintering.

Therefore, according to the invention, plates suitable for side containment in continuous casting machines can be obtained, having regions with different thermomechanical features in order to enable an optimum coupling to the side faces of the rolls at the start of the casting process as well as during the entire casting process, thus enabling the implementation of casting processes free of inconveniences such as molten metal penetration between the plates and the rolls, or premature wear of the plates, thereby reducing the manufacturing costs and increasing the volume of flat products thus manufactured.

Advantageously, according to the invention and to a further embodiment thereof, it is possible to implement plates having a variety of plate members as inserts incorporated therein, each differing from the others and implemented in the various abovedescribed embodiments thereof, said plate members being positioned along the contacting arc of the edges of the rolls onto the plate, so as to obtain different thermomechanical features of the plate itself, and according to the use and to the type of molten metal to which the machine is provided.

The present invention is not limited to the above-disclosed embodiments, and it covers all the different embodiments included within the scope of the following claims.

What is claimed is:

1. A refractory plate member (8) for side containment in continuous casting machines having two counterrotating rolls (1, 2) sliding onto a surface of said plate member (8), said plate member (8) including two or more overlapped ceramic and refractory layers (9,91,10,101), wherein the first layer (9,91) of said plate member (8) contacts the rolls (1,2) and is made of a material easily wearable when sliding onto said rolls, and the second layer (10,101) underlying said first layer (9,91) is made of a material having a very high wear and thermal shock resistance, the plate member (8) being characterized in that:

said first layer is made of a material (9) including from 20 to 30% BN by weight with respect to the total weight, the remaining materials in the total weight comprising one or more component materials chosen from the group consisting of $Al_2O_3$, $SiO_2$, SiC, $ZrO_2$, and SiAlON; and said second layer comprises a graphitic carbon material (10) obtained through a hot pressing process starting from a carbon matrix, with a grain size ranging from 30 to 250 $\mu$m, wherein graphite flakes having a size from 50 to 125 $\mu$m and a final porosity from 6 to 15% are incorporated.

2. The plate member (8) according to claim 1 wherein said two or more layers (9,91,10,101) are monolithic, obtained by a simultaneous isostatic hot pressing of two or more overlapped materials that are intimately composite and chemically bound therebetween.

3. The plate member (8) according to claim 1, wherein the two or more layers of material (9,91,10,101) are obtained by a simultaneous uniaxial cold pressing of overlapped ceramic mixtures and of a subsequent sintering thereof.

4. The plate member (8) according to claim 1, wherein said first layer is made of a first refractory and ceramic material (9,91) applied onto a second refractory material (10,101), the second refractory material (10,101) being obtained by an isostatic hot pressing or by a uniaxial cold pressing and a subsequent sintering thereof.

5. The plate member (8) according to claim 1, wherein the thickness of said first layer (9,91) is in the range of 0.5–5 mm.

6. The plate member (8) according to claim 1, wherein each of the materials forming said two or more layers (9,91,10,101) of the plate member (8) has a thermal expansion coefficient which does not differ from the other materials by more than 50%.

7. A side containment plate (11) for molten metal in continuous casting machines having a pair of counterrotating rolls (1,2), the plate (11) incorporating at least one plate member (8) formed according to claim 1, said at least one plate member (8) being mounted on said plate (11) so as to form a monolithic refractory structure.

8. A refractory plate member (8) for side containment in continuous casting machines having two counterrotating rolls (1, 2) sliding onto a surface of said plate member (8), said plate member (8) including two or more overlapped ceramic and refractory layers (9,91,10,101), wherein the first layer (9,91) of said plate member (8) contacts the rolls (1,2) and is made of a material easily wearable when sliding onto said rolls, and the second layer (10,101) underlying said first layer (9,91) is made of a material having a very high wear and thermal shock resistance, the plate member (8) being characterized in that:

said first layer (9,91) is made of a refractory fibrous casting matrix based on at least one of an aluminum, a silicon/aluminum, and a zirconium material, said refractory fibrous casting matrix comprising one or more component material powders having grain sizes of less than 60 $\mu$m and being chosen from the group consisting of $Al_2O_3$, $SiO_2$, and $ZrO_2$; and said second layer comprises a graphitic carbon material (10,101) obtained through a hot pressing process starting from a carbon matrix, with a grain size ranging from 30 to 250 $\mu$m, wherein graphite flakes having a size from 50 to 125 $\mu$m and a final porosity from 6 to 15% are incorporated.

9. The plate member (8) according to claim 8 wherein said two or more layers (9,91,10,101) are monolithic, obtained by a simultaneous isostatic hot pressing of two or more overlapped materials that are intimately composite and chemically bound therebetween.

10. The plate member (8) according to claim 8, wherein the two or more layers of material (9,91,10,101) are obtained by a simultaneous uniaxial cold pressing of overlapped ceramic mixtures and of a subsequent sintering thereof.

11. The plate member (8) according to claim 8, wherein said first layer is made of a first refractory and ceramic material (9,91) applied onto a second refractory material (10,101), the second refractory material (10,101) being obtained by an isostatic hot pressing or by a uniaxial cold pressing and a subsequent sintering thereof.

12. The plate member (8) according to claim 8, wherein the thickness of said first layer (9,91) is in the range of 0.5–5 mm.

13. The plate member (8) according to claim 8, wherein each of the materials forming said two or more layers (9,91,10,101) of the plate member (8) has a thermal expansion coefficient which does not differ from the other materials by more than 50%.

14. A side containment plate (11) for molten metal in continuous casting machines having a pair of counterrotating rolls (1,2), the plate (11) incorporating at least one plate member (8) formed according to claim 8, said at least one plate member (8) being mounted on said plate (11) so as to form a monolithic refractory structure.

* * * * *